US009110412B2

(12) United States Patent
Liu

(10) Patent No.: US 9,110,412 B2
(45) Date of Patent: Aug. 18, 2015

(54) METHODS AND SYSTEMS FOR GENERATING DIFFERENTIAL GLOSS IMAGE BY PRE-HEATING MARKING MATERIAL ON A SUBSTRATE

(75) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 111 days.

(21) Appl. No.: 13/539,416

(22) Filed: Jun. 30, 2012

(65) Prior Publication Data

US 2014/0003849 A1 Jan. 2, 2014

(51) Int. Cl.
*G03G 15/20* (2006.01)

(52) U.S. Cl.
CPC .. *G03G 15/2021* (2013.01); *G03G 2215/00805* (2013.01)

(58) Field of Classification Search
USPC ..... 399/341
See application file for complete search history.

(56) References Cited

U.S. PATENT DOCUMENTS

| | | | | |
|---|---|---|---|---|
| 4,503,437 | A | 3/1985 | Katzschner | |
| 5,184,152 | A | 2/1993 | French | |
| 5,220,356 | A | 6/1993 | Yaginuma | |
| 5,369,419 | A | 11/1994 | Stephenson et al. | |
| 5,436,710 | A * | 7/1995 | Uchiyama | 399/336 |
| 5,519,426 | A | 5/1996 | Lukis et al. | |
| 6,066,829 | A | 5/2000 | Ishikawa | |
| 7,920,279 | B2 * | 4/2011 | Ernst et al. | 358/1.12 |
| 2002/0159785 | A1 * | 10/2002 | Masuda et al. | 399/69 |
| 2008/0101832 | A1 | 5/2008 | Yaoi et al. | |
| 2009/0245896 | A1 * | 10/2009 | Ishikake et al. | 399/328 |
| 2011/0038653 | A1 * | 2/2011 | Egusa et al. | 399/336 |
| 2011/0058869 | A1 * | 3/2011 | Kagawa | 399/336 |
| 2011/0262196 | A1 | 10/2011 | Maeda | |
| 2012/0039643 | A1 * | 2/2012 | Chang et al. | 399/320 |

FOREIGN PATENT DOCUMENTS

| | | | |
|---|---|---|---|
| JP | 61091678 A | * | 5/1986 |
| JP | 03211576 A | * | 9/1991 |
| JP | 2008129061 A | * | 6/2008 |

OTHER PUBLICATIONS

Chu-Heng Liu, U.S. Appl. No. 13/462,671, filed May 2, 2012.
Bryan J. Roof, U.S. Appl. No. 13/539,533, filed Jul. 2, 2012.
Chu-heng Liu, U.S. Appl. No. 13/462,485, filed May 2, 2012.
Chu-heng Liu, U.S. Appl. No. 13/539,421, Office Action dated Aug. 2, 2013.
Chu-heng Liu, U.S. Appl. No. 13/539,421, Office Action dated Jan. 7, 2014.
Chu-heng Liu, U.S. Appl. No. 13/597,537, Office Action dated Nov. 5, 2013.

* cited by examiner

*Primary Examiner* — Quana M Grainger
(74) *Attorney, Agent, or Firm* — Ronald E. Prass, Jr.; Prass LLP

(57) ABSTRACT

A system for generating a differential gloss image useful for digital printing includes a image production system, a pre-heating system for heating a marking material image formed by the image production system, and an imaging system for forming a differential gloss image on the pre-heated marking material image.

18 Claims, 3 Drawing Sheets

METHODS AND SYSTEMS FOR GENERATING DIFFERENTIAL GLOSS IMAGE BY PRE-HEATING MARKING MATERIAL ON A SUBSTRATE

RELATED APPLICATIONS

This application is related to co-pending U.S. patent application Ser. No. 13/462,485 titled "METHODS AND APPARATUS FOR GENERATING DIFFERENTIAL GLOSS IMAGE USING LASER ENERGY," the disclosure of which is incorporated by reference herein in its entirety, and co-pending U.S. patent application Ser. No. 13/539,421 titled "METHODS AND SYSTEMS FOR GENERATING DIFFERENTIAL GLOSS IMAGE USEFUL FOR DIGITAL PRINTING," the disclosure of which is incorporated by reference herein in its entirety

FIELD OF DISCLOSURE

The disclosure relates to methods and systems for producing differential gloss images. In particular, the disclosure relates to methods and systems for producing images on pre-heated marking material fixed to a substrate.

BACKGROUND

Gloss is an image or substrate attribute that describes how much specular reflection is observed from a surface of a substrate. Specular reflection is the mirror-like reflection of light from a surface, in which light from a single incoming direction is reflected in a single outgoing direction. Because the surface of the substrate is not always perfectly flat, the light reflected from the surface of the substrate is not similar to what would generally be reflected from a mirror. When a surface of a substrate is rough, the percentage of the light that is reflected as specular reflection is less. In general, the rougher the surface, the lesser the chance of the reflected light is going to travel in the direction of the specular reflection. By varying the roughness of the surface, different types of finishes may be achieved.

Generating a differential gloss image using a laser glossing imager to overlay a gloss image on an existing printed image is limited by print speed and image contrast. For example, a toner or ink image that absorbs laser energy from a laser glossing imager is pulse-heated to a temperature above the melting point of the toner or ink for short period of time. Typical laser imagers used for ink-based digital printing, for example, have power capabilities that are barely sufficient to produce differential gloss images at half of a speed of printing, e.g., the toner or ink image on which the gloss image is to be printed.

SUMMARY

Methods and apparatus for creating an image by applying energy to marking material on a substrate are disclosed in U.S. patent application Ser. No. 13/462,485 titled "METHODS AND APPARATUS FOR GENERATING DIFFERENTIAL GLOSS IMAGE USING LASER ENERGY." Methods and systems for creating high contrast gloss images by applying energy to marking material on a substrate art improved print speeds are desired.

In an embodiment, systems for generating a differential gloss image useful for digital printing may include a pre-heating system configured to heat marking material on a substrate; and an imaging device configured to expose the pre-heated marking material to radiation. Systems may include the imaging device having a laser glossing imager. The laser glossing imager may be configured to extend a full width of a printed image such as a toner image transported by a media pathway. Alternatively, the laser glossing imager may extend a partial width of a printed image transported by a media pathway.

In an embodiment, systems may include the pre-heating system having a heating device configured to heat marking material to a temperature above room temperature. For example, the heating device may be configured to heat the marking material by way of convection heating.

In an embodiment, systems may include an image production device configured to apply marking material to the substrate before the substrate passes the imaging device, the imaging device and the image production device being arranged along a substrate transport pathway. The marking material may comprise toner. Alternatively, the marking material may comprise ink.

In an embodiment, the image production device may be a xerographic marking engine. The heating device may include components of a fixing assembly such as a fuser roll forming a fusing nip for fixing a printed image to the substrate, the fuser roll being a heated fuser roll configured to heat and fix the toner to the substrate.

In an embodiment, methods of generating a gloss image useful for digital printing may include heating a marking material image on a substrate using a pre-heating system; and causing an imaging device to expose at least a portion of the marking material image to radiation. Methods may include heating the marking material to a temperature above a room temperature. In an embodiment, methods may include the exposing including heating the marking material to a temperature at or above a melting point of the marking material.

In an embodiment, the marking material may comprise toner. Methods may include depositing toner on the substrate before the pre-heating to form the printed image. The toner may be deposited by a xerographic marking engine. In an embodiment, the marking material may comprise ink. Methods may include jetting ink on the substrate to form the marking material image using an inkjet printhead.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
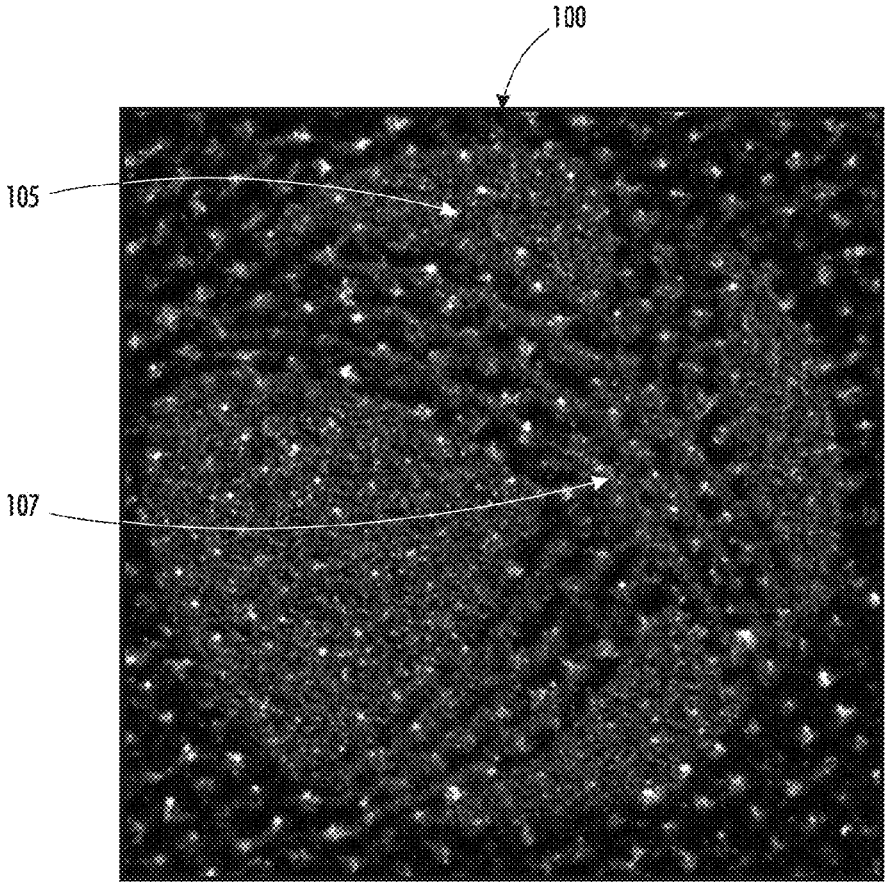
FIG. 1 shows a microscopic view of a gloss image overlaid on a printed image using systems and methods for generating a differential gloss image.

Exemplary embodiments are intended to cover all alternatives, modifications, and equivalents as may be included within the spirit and scope of the methods and systems as described herein.

Methods for enabling an image production device to generate differential gloss for a print may include exposing a marking material of a printed image to radiation emitted by an imaging device, such as a laser, to selectively cause one or more portions of the marking material image to melt. The marking material is disposed on a substrate that remains substantially unaffected by the laser. Before exposing the marking material to a laser emitted by the imaging device, the marking material may be pre-heated by a heating device configured to emit thermal energy for absorption by the marking material.

Systems may include an image production device having a processor and an imaging device such as a laser or laser glossing imager coupled to the processor. The image production device, pre-heating device, imaging device or laser glossing imager, and/or processor may be coupled to a data source, such as an external data source. The data source may be remotely or locally disposed with respect to the image production device. For example, the image production device may also include a local user interface for controlling its operations, although another source of image data and instructions may include any number of computers to which the printer is connected by way of a network. The image production device may be any device that may be capable of making image production documents (e.g., printed documents, copies, etc.) including a copier, a printer, a facsimile device, and a multi-function device (MFD), for example. The image production device may be a digital printing system configured for printing with lithographic inks, for example.

The laser may be configured to emit radiation by way of a concentrated beam to melt one or more portions of an ink or toner image printed on a substrate, which remains substantially unaffected by the radiation, to alter the surface of the ink or toner image. Differential gloss images may be generated on or over images printed with marking material such as hot melt toner or ink. Any suitable marking material such as toner or ink may be used, and printed images on which a gloss image may be generated may be produced by xerographic, liquid toner, or solid inkjet processes. The energy from the laser applied to the surface of the one or more portions of, e.g., the toner image transforms the one or more portions from a substantially flat surface to a rough surface. The one or more portions of the toner image are selectively exposed to, for example, a laser beam emitted by the laser glossing imager.

In related art systems, a substantial amount of laser energy is used to increase a temperature of the marking material image from a room temperature to a temperature at or above a melting point of the marking material. This method limits, however, the speed and image contrast of generated differential gloss images.

Embodiments of methods include pre-heating a printed marking material image to a temperature above a room temperature before exposing the marking material to radiation emitted by an imaging device such as a laser glossing imager configured for generating a differential gloss image. Embodiments of systems may include a pre-heating device configured to emit thermal radiation for heating marking material printed on a substrate. The pre-heating device may be positioned along a media or substrate transport path at a position preceding a laser glossing imager, with respect to a process direction of the substrate.

The disclosed embodiments may include a computer-readable medium storing instructions for controlling an image production device to generate a print having differential gloss. The instructions may be configured to cause a heating device to pre-heat marking material on a substrate, and/or an imaging device such as a laser glossing imager to lase or heat select portions of a marking material image on a substrate to melt the select portions of the marking material image, the pigments of the toner, for example, absorbing the energy emitted by the laser glossing imager.

The image production device may include an image production section and a gloss image creation section. When a printed sheet is processed by the image production section, it may then be moved to the gloss image creation section. A pre-heating device may be included in the image production section or the gloss image creation section. In an embodiment, a laser glossing imager may be used in the gloss image section to act upon a primary image that has contrast in color or density, to superimpose a secondary image with distinct contrast in gloss. Before laser imaging, the marking material may be pre-heated to a temperature that enables the laser glossing imager to quickly reach a temperature at or above the melting point of the marking material fixed to the substrate. The printed sheet with both a primary color/density image and a secondary gloss image thereon may then be moved to an output section, where it may be collated, stapled, folded, etc., with other media sheets in manners familiar in the art.

The image production device may include a bus, a processor, a memory, a read only memory (ROM), pre-heating device, an imaging device such as a laser glossing imager, a cooling section, a feeder section, an output section, a digital front end including, for example, a user interface, a communication interface, an image production section, and a scanner. The bus may permit communication among the components of the image production device. The digital front end may be remotely located with respect to the imaging device and/or processor, for example, and may be configured for communicating by wired or wireless connections with components of the image production device.

The processor may include at least one conventional processor or microprocessor that interprets and executes instructions. The memory may be a random access memory (RAM) or another type of dynamic storage device that stores information and instructions for execution by a processor. The memory may also include a read-only memory (ROM) which may include a conventional ROM device or another type of static storage device that stores static information and instructions for the processor.

The communication interface may include any mechanism that facilitates network communication. For example, a communication interface may include a modem. Alternatively, communication interface may include other mechanisms for assisting in communications with other devices and/or systems.

ROM may include a conventional ROM device or another type of static storage device that stores static information and instructions for the processor. A storage device may augment the ROM and may include any type of storage media, such as, for example, magnetic or optical recording media and its corresponding drive.

The user interface may include one or more conventional mechanisms that permit a user to input information to and interact with the image production device, such as a keyboard, a display, a mouse, a pen, a voice recognition device, touchpad, buttons, etc., for example. The output section may include one or more conventional mechanisms that output image production documents to the user, including output trays, output paths, finishing section, etc., for example. The image production section may include an image printing and/or copying section, a scanner, a fuser, etc., for example.

The imaging device may be a laser glossing imager. The laser glossing imager may include a high power laser source to provide sufficient laser energy to cause an ink or toner image to melt. For this purpose, the laser glossing imager may serve as a heating device. For example, the laser glossing imager may be used to output the laser power in a certain pattern. This may cause different levels of roughness on the toner image, and therefore may affect a gloss appearance. The laser glossing imager may be a separate module, or may be implemented as part of another module or component of the image production device.

A cooling section may be configured to cool the toner image after the one or more portions of the toner image begin to melt. Although the cooling section is described herein as a separate module, it may be that the cooling section may be implemented as part of another module or component of the image production device. For some embodiments, the cooling section may be optional because the cooling may occur naturally as the heat diffuses away quickly from the local heating spot.

The image production device may perform such functions in response to processor by executing sequences of instructions contained in a computer-readable medium, such as, for example, memory. Such instructions may be read into memory from another computer-readable medium, such as a storage device or from a separate device by way of a communication interface.

Although not required, the disclosure will be described, at least in part, in the general context of computer-executable instructions, such as program modules, being executed by the image production device, such as a communication server, communications switch, communications router, or general purpose computer, for example.

Generally, program modules include routine programs, objects, components, data structures, etc. that performs particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Methods and system are useful for generating an image on a printed image. The image may comprise marking material such as toner or ink on a substrate such as a paper sheet. The substrate may be flexible (e.g., paper, transparency, etc.) The toner image may be a film of certain thickness (e.g., five microns), and may include embedded pigments. The pigments may absorb the laser power, and may reach a high temperature causing the toner image to melt. The substrate may serve as a heat sink that cools down the toner image. The cooling of the toner may also be performed by the cooling section.

Prior to generating a differential gloss image on the toner image, the toner image may have uniform gloss. For example, the material (or combination of the substrate and the toner image) may be a print. For photography or print applications, the common finishes desirable by consumers are glossy finish and matte finish.

In general, differential gloss refers to a glossy finish that may be achieved by providing a contrast of more glossy areas and less glossy areas. For example, surfaces with greater roughness will typically be less glossy. By modulating the surface roughness in an image-wise fashion, an image with distinct gloss contrast can be created. For some embodiments, the imaging device, e.g., a laser glossing imager may be used to concentrate energy onto certain areas of an ink or toner image. The laser may output short pulses of radiation having a power high enough to cause the toner to melt. A pre-heating device and process may cause the toner to melt more quickly when subsequently exposed to energy emitted by the laser glossing imager. This may cause the surface of the ink or toner image to change. Such surface change affects an image gloss, and depending on an initial state of toner or ink material and an amount of laser exposure, a gloss of an image may increase or decrease based on a surface change of the ink or toner. For example, a black patch of a print may have a substantial uniform gloss. When the laser glossing imager is applied to selected areas of the black patch, the ink of the areas that are exposed to the laser may become rougher or smoother because of melting and subsequent solidification. The areas of the black patch that are not exposed to the laser may maintain the original gloss. As a result of applying the laser from the laser glossing imager, there may be an image that can be seen as having differential gloss on top of the original printed image. The image on top of the original image may be independent of the underlying original image, and it may be adjusted by varying the laser pattern from the laser glossing imager. It should be noticed that the substrate may remain substantially the same with minimal or no impact caused by the laser from the laser glossing imager.

For some embodiments, the power of the laser energy from the laser glossing imager may only be sufficient enough to cause melting of the toner image but may not be too much more to avoid evaporation or ablation of the toner image or the substrate. For example, the energy requirements may be ~1 kW/cm2 (100~10000 W/cm2) for power density, and ~1 J/cm2 (0.1~10 J/cm2) for energy density. This is different from the laser energy typically associated with laser ablation/engraving techniques where the laser energy is strong enough to be used in etching application of hard materials (e.g., stone, ceramic, etc.). For example, the typical laser energy requirements for laser ablation/engraving may be 1~100 MW/cm2 for power density, and 1~100 J/cm2 for energy density, where MW is Mega Watts. In addition, the laser ablation/engraving techniques may cause evaporation or removal of the material, whereas there is minimal or no evaporation or removal of the material caused by the embodiments of the present invention.

An imaging device such as a laser glossing imager may be applied using a combination of a beam and a x-y table. Alternatively, a line exposure of laser may be created in one direction while the substrate may travel in a different direction such as, for example, a direction perpendicular to a toner image and substrate process direction.

The pre-heating device may be used to preheat marking materials such as ink or toner on a substrate before the substrate arrives at an imaging device such as a laser glossing imager for laser treatment. Preheating may improve system performance by enhancing image contrast and enabling higher print speeds. Print speed and image contrast may be significantly improved over differential gloss image printing systems that they do not use a pre-heating device. Pre-heating can be implemented with many conventional methods of heating including roll heating, convention heating, radiation heating, oven heating, etc. In an embodiment, laser imaging may be carried out on a toner image immediately after fusing the toner image at a fusing station. Fusing station may include a heated fuser roll, which may serve to pre-heat the toner on the toner image before the toner image arrives at a differential gloss imaging device such as a laser glossing imager.

Images made of hot melt resin such as toner and hot melt ink can be re-melted when subject to high temperatures. Laser pulse re-heat provides unique re-heating characteristics. For example, heat is delivered by the laser pulse in a very short time, e.g., n microseconds to about one millisecond. The heating is very localized. Heat may be applied to only small regions that absorb the laser power, such as individual toner particles or pigments. Cooling may be very fast, a matter of milliseconds, because heating pulse is short, and the heat may only be delivered to the laser absorbing ink/toner.

When images are subject to laser re-heating, the image surface develops roughness characteristics that are different from image surfaces that have gone through regular image fusing/curing/solidification processes including slow and uniform heating wherein a surface is subject to pressure contact during heating and cooling. These distinct surface roughness characteristics result in a strong gloss contrast or a differential gloss image.

FIG. 1 shows a microscopic view of a differential gloss image produced by systems and methods. To produce the differential gloss image shown on FIG. 1, 90% black halftone patches printed by Xerox iGen3 printer at 1701 DPI is used. A laser glossing imager produced a Xerox logo at 600 dpi over the printed image at 20 centimeters per second. In particular, FIG. 1 shows a differential gloss image 100 having a lighter region 105. The lighter region 105 has been exposed to a high power laser and has a roughness scale of a few microns. The image is a shown as a scattering view and therefore the laser exposed region appears lighter, which implies a lower gloss. The darker region 107 has not been exposed to the high power laser. Depending on an initial state of the ink or toner material and an amount of laser exposure, it has also been found that the laser exposed region may achieve higher gloss than untreated regions.

When producing a differential gloss image, a substantial amount of laser energy is used to raise the temperature of the toner or ink image from a room temperature to a melting point. This can be an ineffective way to use laser power, and limits print speed and image contrast of differential gloss images.

A pre-heating device may be a conventional heating device and may be used to raise the temperature of a toner or ink image above a room temperature, for example, and/or close to a melting point before a laser glossing imager is used to increase the temperature of the toner or ink to a temperature at or above the melting point. Accordingly laser power may be conserved, and pre-heating may enable improved system speed, image quality, and laser glossing imager life span.

Figure 2:
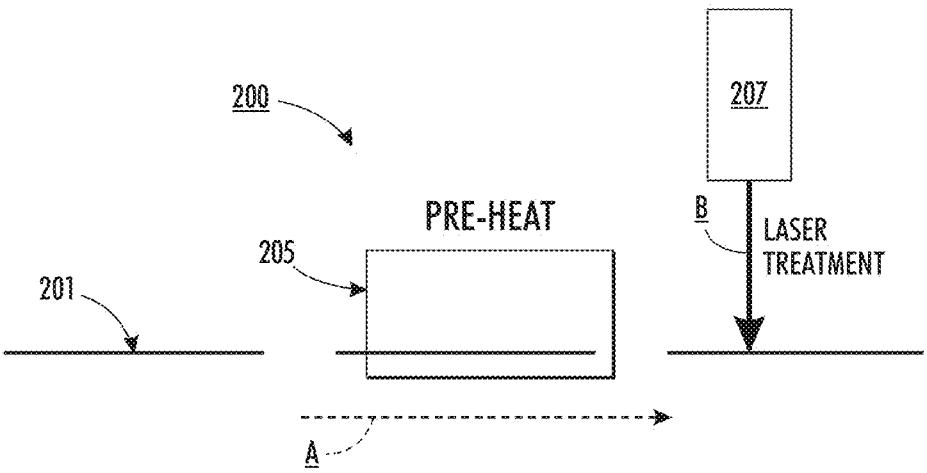
FIG. 2 shows a diagrammatical view of a system for generating a differential gloss image by pre-heating marking material on a substrate before treating the marking material with energy from a laser glossing imager.

Pre-heating may be implemented with many conventional heating methods including roll heating, convection heating, radiation heating, oven heating, flash heating, etc. In a standalone system, a pre-heating subsystem may be located prior to a laser glossing imager. For example, FIG. 2 shows a system in accordance with an embodiment. In particular, FIG. 2 shows a differential gloss image printing system including a pre-heating device. FIG. 2 shows substrate 201 that is transported to a pre-heat device 205, and then to a laser glossing imager 207 for laser treatment. Substrate 201 is transported in a process direction and corresponds to a direction of the arrow A. At the pre-heating device 205, toner or ink affixed to a surface of the substrate 201 may be heated to a temperature above, for example, room temperature. After pre-heating the toner or ink image at the pre-heating device 205, a substrate 201 may be transported to the laser glossing imager 207. The laser glossing imager 207 may be configured to a laser beam in a direction corresponding to the arrow B to heat the pre-heated ink or toner to a temperature at or above a melting point of the ink or toner.

Figure 3:
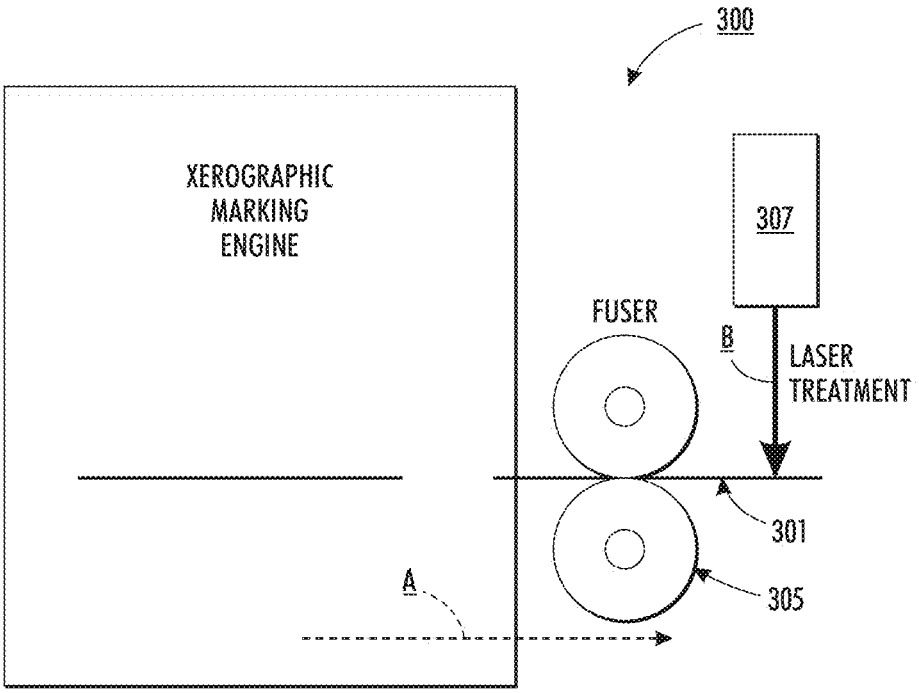
FIG. 3 shows a diagrammatical view of a system for generating a differential gloss image by pre-heating marking material on a substrate before treating the marking material with energy from a laser glossing imager.

FIG. 3 shows an embodiment of a differential gloss image printing system. System 300 includes an image production device having a xerographic marking engine and a fuser. In particular, the system 300 includes a substrate 301 that is transported from a xerographic marking engine to a fuser 305.

The substrate 301 may include marking material deposited by the xerographic marking engine, and may be transported in the direction corresponding to the arrow A to the fuser 305 for fusing the toner image to the substrate 301. The fuser 305 may include a heated fuser roll, and the fuser 305 may be configured to apply heat and pressure for fixing the toner to the substrate 301 to produce a toner image. The toner image on the substrate 301 may be transported in a process direction corresponding to the arrow A to a laser glossing imager 307.

The laser glossing imager 307 may be configured to emit a laser beam in a direction corresponding to the arrow B for laser treatment of the toner image on the substrate 301. The toner image on the substrate 301 is pre-heated by the heated fuser roll of the fuser 305 to a temperature, for example, above a room temperature. The laser glossing imager 307 is configured to heat the pre-heated toner of the toner image to a temperature at or above a melting point of the toner.

Example

Figure 4:
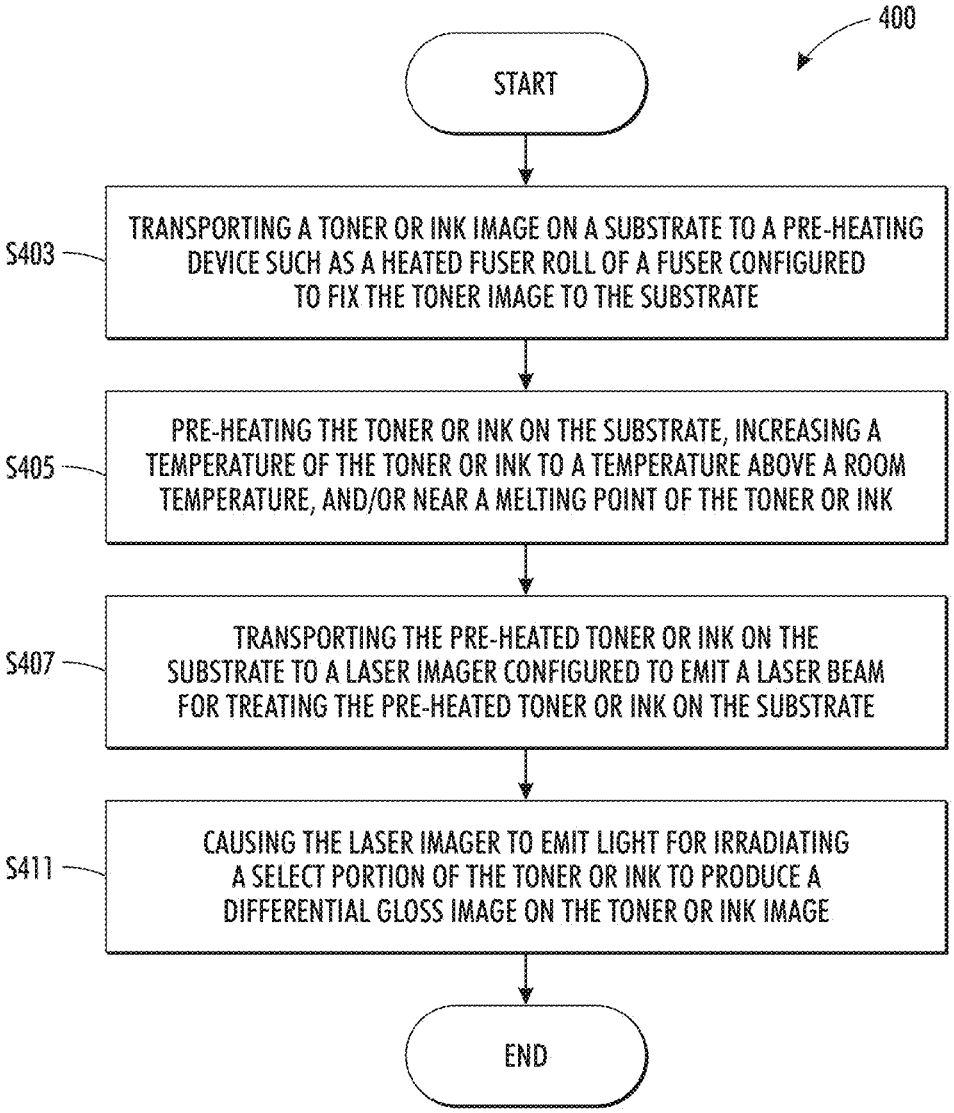
FIG. 4 shows methods for generating a differential gloss image by pre-heating marking material on a substrate before treating the marking material with energy from a laser glossing imager.

A black patch of toner was used for a print test. That test was run using 25 A of laser current, and a print speed of 25 centimeters per second. A differential gloss image or a laser gloss image was not visible. In a second print run, convection heating was used to warm the toner image to about 70° C. prior to applying laser energy to the toner image. After applying laser energy to the toner of the black patch toner image, a desired gloss image was visible. Pre-heating may improve print speeds by 30% relative to differential gloss image printing systems that require a laser device to heat toner from a temperature at or below room temperature to a temperature at or above a melting point of the toner. Differential gloss image printing methods in accordance with embodiments may include a step of pre-heating a toner or ink toner or ink image before laser treating the toner to produce a gloss image. FIG. 4 shows a method of producing a differential gloss image on a printed image in accordance with an embodiment. In particular, FIG. 4 shows a differential gloss image printing method 400. The method 400 includes transporting a toner or ink image on a substrate to a pre-heating device such as a heated fuser roll of a fuser configured to fix the toner to the substrate at S403. For example, toner may be applied to substrate by a xerographic marking engine to produce a toner image on the substrate. The toner image may be fixed to the substrate using heat and pressure by the fuser.

A heated fuser roll of the fuser may be used for pre-heating the toner on the substrate at S405. The pre-heating increases the toner temperature to a temperature above a room temperature, and/or near a melting point of the toner or ink.

The pre-heated toner on the substrate may be transported to a laser glossing imager at S407. The laser glossing imager may be configured to emit a laser beam for laser treating the toner on the substrate. The laser glossing imager may be configured to selectively treat portions of the toner image for generating a differential gloss image on the fixed and pre-heated toner image.

Methods may include causing the laser glossing imager to emit light or a laser beam for irradiating select portions of the toner to produce a differential gloss image on the toner at S411.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD- ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A system for generating a differential gloss image useful for digital printing, comprising:

a pre-heating system configured to pre-heat marking material on a substrate, the pre-heating system being a fuser that fuses the marking material to the substrate, the fuser pre-heating the marking material to a temperature above room temperature and near a melting point of the marking material; and an imaging device configured to perform an imaging function by exposing a first portion of the fused pre-heated marking material to radiation at a higher power level than a second portion of the fused pre-heated marking material to create a first gloss level on the first portion and a second gloss level on the second portion, wherein the first gloss level and the second gloss level are different gloss levels, the fuser performs the pre-heating at a nip between two rolls, and the imaging device performs the imaging function after the fused marking material leaves the fuser.

2. The system of claim 1, the imaging device further comprising a laser glossing imager.

3. The system of claim 2, the laser glossing imager extending a full width of a printed image transported by a media pathway.

4. The system of claim 2, the laser glossing imager extending a partial width of a printed image transported by a media pathway.

5. The system of claim 1, further comprising an image production device configured to apply marking material to the substrate before the substrate passes the imaging device, the imaging device and the image production device being arranged along a substrate transport pathway.

6. The system of claim 5, the marking material comprising toner.

7. The system of claim 5, the marking material comprising ink.

8. The system of claim 5, the image production device comprising a xerographic marking engine.

9. A method of generating a gloss image useful for digital printing, comprising:

pre-heating a marking material image on a substrate using a pre-heating system, the pre-heating system being a fuser that fuses the marking material to the substrate, the fuser pre-heating the marking material to a temperature above room temperature and near a melting point of the marking material; and causing an imaging device to perform an imaging function by exposing a first portion of the fused pre-heated marking material to radiation at a higher power level than a second portion of the fused pre-heated marking material to create a first gloss level on the first portion and a second gloss level on the second portion, wherein the first gloss level and the second gloss level are different gloss levels, the pre-heating takes place at a nip between two rolls of the fuser, and the imaging function is performed after the fused marking material leaves the fuser.

10. The method of claim 9, the exposing further comprising heating the marking material to a temperature at or above a melting point of the marking material.

11. The method of claim 10, the marking material comprising toner.

12. The method of claim 10, the marking material comprising ink.

13. The method of claim 11, further comprising depositing toner on the substrate before the pre-heating to form the printed image.

14. The method of claim 11, the toner being deposited by a xerographic marking engine.

15. The method of claim 10, the marking material comprising ink.

16. The method of claim 10, further comprising jetting ink on the substrate to form the marking material image using an inkjet printhead.

17. The method of claim 9, wherein the pre-heating takes place entirely in the nip.

18. The system of claim 1, wherein the pre-heating takes place entirely in the nip.

* * * * *